United States Patent [19]

Rilett

[11] 4,356,699

[45] Nov. 2, 1982

[54] GAS CONDENSATION

[76] Inventor: John W. Rilett, Hilltop House, Old Quarry, Bibury, Great Britain

[21] Appl. No.: 226,827

[22] Filed: Jan. 21, 1981

[30] Foreign Application Priority Data

Jan. 2, 1980 [GB] United Kingdom ..... 8002190

[51] Int. Cl.[3] ..... F17C 13/00

[52] U.S. Cl. ..... 62/54; 165/133

[58] Field of Search ..... 62/54, 55.5, 48; 165/133

[56] References Cited

U.S. PATENT DOCUMENTS

| | | | |
|---|---|---|---|
| 3,266,262 | 8/1966 | Moragne | 62/54 |
| 3,344,852 | 10/1967 | Bergson | 62/55.5 |
| 3,538,714 | 11/1970 | Kling et al. | 62/54 |
| 3,714,942 | 2/1973 | Fischel et al. | 62/54 |

FOREIGN PATENT DOCUMENTS

| | | |
|---|---|---|
| 876738 | 9/1961 | United Kingdom . |
| 972193 | 10/1964 | United Kingdom . |
| 972698 | 10/1964 | United Kingdom . |
| 1008471 | 10/1965 | United Kingdom . |
| 1015522 | 1/1966 | United Kingdom . |
| 1120816 | 7/1968 | United Kingdom . |
| 1213072 | 11/1970 | United Kingdom . |
| 1217705 | 12/1970 | United Kingdom . |
| 1102464 | 2/1978 | United Kingdom . |

*Primary Examiner*—Ronald C. Capossela
*Attorney, Agent, or Firm*—Weingarten, Schurgin, Gagnebin & Hayes

[57] ABSTRACT

A pressure-liquefiable gas or vapor fed into the interior of a container which may constitute the fuel tank of a power unit for a model aircraft or other working model, is condensed within the container by introducing either a liquid derived from said gas or vapor or a liquid refrigerant from an external source into the interior of a hollow condensing element mounted in the container with its outer surface in contact with said gas or vapor inside the container, and then exhausting the contents of the condensing element to cool the outer surface thereof to a temperature below the condensation temperature of said gas or vapor.

20 Claims, 3 Drawing Figures

GAS CONDENSATION

The present invention relates to the condensation of gases. In general, the invention is concerned with the condensation of gases that may be liquefied at normal climatic temperatures under the effect of pressure alone, such as carbon dioxide, the FREONs (Registered Trade Mark), butane, propane and ammonia. In particular, the present invention is concerned with the condensation of such gases in the tanks that supply gas to gas-operated motors but it may also be applied to other containers, vessels, condensers or other equipment in which the easy condensation of a pressure-liquefiable gas is desired.

Motors driven by a supply of pressurised carbon dioxide are known and have been used for example as the power plants of model aircraft. Such motors generally employ a tank to contain the pressurised carbon dioxide and the normal practice is to charge this tank by connecting it to another container holding liquid carbon dioxide. A major disadvantage of this practice is that vaporised carbon dioxide within the tank or entering the tank during the charging process does not condense and so limits the amount of liquid carbon dioxide which can be charged into the tank. In consequence the tank must be greatly increased in size and weight in order to carry the desired quantity of carbon dioxide.

A further problem relating to such motors and their supply tanks is that, if the level of liquid carbon dioxide within the tank is higher than the centre of volume for example, there is a risk of liquid carbon dioxide being supplied to the motor which may be damaged in consequence.

Very much larger motors, for example of the turbine type driven by vapour that after expansion in the turbine is condensed and then vaporised again for re-use in a closed cycle, are also known and also suffer from difficulties in condensing the vapour. British Pat. No. 1,102,464 describes a closed cycle turbine power plant wherein a liquid coolant is used to promote condensation of the expanded vapour, but at the cost of considerable complexity.

The main object of the present invention is to promote the easy condensation of a vapour within a tank or other apparatus associated with a motor or a device supplied by a gas or a vapour. However, the present invention may equally be applied to promote the easy condensation of a vapour in any container, for example for the filling of containers with carbon dioxide or like gas for use in a variety of applications.

To this end, according to a first aspect of the invention, there is provided a method of condensing a pressure-liquefiable gas or vapour, said method comprising feeding said gas or vapour into the interior of a closed container, introducing either a liquid derived from said gas or vapour or a liquid refrigerant from an external source into the interior of a hollow condensing element mounted in said container with its outer surface in contact with the gas or vapour inside the container, and exhausting the contents of said condensing element to cool the outer surfaces thereof to a temperature below the condensation temperature of said gas or vapour.

According to a second aspect of the invention, there is provided apparatus for promoting the condensation of a pressure-liquefiable gas or vapour, said apparatus comprising a closed outer container having an inlet for said gas or vapour, an inner condensing element mounted within said container and comprising a hollow receptacle the exterior of which is exposed to the contents of the container and the interior of which communicates either with the interior of said container or with an external source of liquid refrigerant, and means for exhausting the contents of said receptacle in order to cool the outer surface of said condensing element to a temperature below the condensation temperature of said gas or vapour.

A further object of the present invention is to reduce the likelihood of liquid phase being supplied by a tank or other apparatus containing liquid carbon dioxide or like gas, for example to prevent liquid carbon dioxide from being supplied to a motor (where it may cause damage) or to a drinks carbonator, or to prevent liquid FREON (Registered Trade Mark) from being expelled from an aerosol dispenser.

To this end, according to a third aspect of the present invention, the gas or vapour is withdrawn from the interior of said container at a point which normally lies above the level of the liquid therein and is given a swirling motion at a velocity sufficient to separate any entrained liquid therefrom by centrifugal force before leaving the container.

In this manner, the receptacle within the container may be exhausted prior to the desired condensation and in consequence of such exhaustion will fall in temperature as liquid phase vaporises and expands from within the receptacle to a lower pressure. Vapour then admitted to the container will contact the cooled receptacle and thereby be induced to condense. Liquid phase thereby condensed within (or otherwise supplied to) the receptacle substantially remains therein until the contents of the container are consumed or carried away, whereupon the receptacle may again be exhausted, cooled and again used to promote a further condensation. This process may be repeated indefinitely.

However, because this process does induce condensation so effectively, it follows that the liquid level within the container may thereby rise to a high level. Consequently, the third aspect of the present invention is, in many cases, necessary to ensure that, in subsequent employment of the container so as to supply vapour or gas, substantially no liquid phase is supplied. Therefore, the third aspect of the present invention (hereinafter referred to as "centripetal gas offtake") is in many cases a necessary part of the overall invention.

Nevertheless the present invention does not exclude those applications wherein it is acceptable to supply liquid phase from the container or wherein other means are employed to vaporise such liquid phase, and hence is not restricted to applications wherein all aspects of the present invention are employed together.

However, in those many applications wherein the high liquid level achieved by the first and second aspects of the present invention may result in the supply of undesired liquid phase, the centripetal gas offtake herein disclosed as the third aspect of the present invention provides a simple means of substantially preventing such liquid phase supply. Accordingly, the centripetal gas offtake comprises firstly an aperture positioned above the level of the liquid surface so as to reduce the likelihood of liquid phase passing into the aperture (though it is to be noted that in many applications such as in the tanks of model aircraft, power plants and other devices it is possible that the motion of the model aircraft or the handling of the device will cause the aperture to become occasionally submerged beneath the liquid surface level and thus to pass liquid phase), secondly a cavity communicating with the aperture and designed to encourage the gas or gas/liquid mixture entering it from the aperture to flow with a swirling or circular motion so that any liquid phase (being of higher density than the gas phase) tends to remain at the outer wall of the cavity owing to its centripetal acceleration and consequent centrifugal force, and thirdly an outlet positioned substantially at the central axis of the circular motion so that gas phase, being less dense than liquid phase, tends to move towards the central axis i.e. tends to move centripetally and thence into the outlet. From the known densities of the gas and liquid phases, the rate at which gas is required to flow from the outlet and the known thermodynamic properties of the pressure-liquefiable gas, it is then possible to design a centripetal gas offtake according to the present invention whereby the angular velocity of the circular motion within the cavity will produce sufficient centripetal acceleration to ensure that only the less-dense gas phase will be available at the central outlet, and to induce vaporisation of the liquid phase at the outer wall by means of the falling pressure gradient ocurring towards the central axis and thereby encouraging the escape of gas phase from the outer liquid phase.

Two preferred embodiments in accordance with the present invention will now be more particularly described, by way of example, and with reference to the accompanying drawings.

FIG. 1 and FIG. 2 refer to a preferred embodiment of the present invention as applied to the gas-supply tank of a gas-operated motor of approximately 5 watts power output.

FIG. 1 is a view in elevation.

Figure 3:
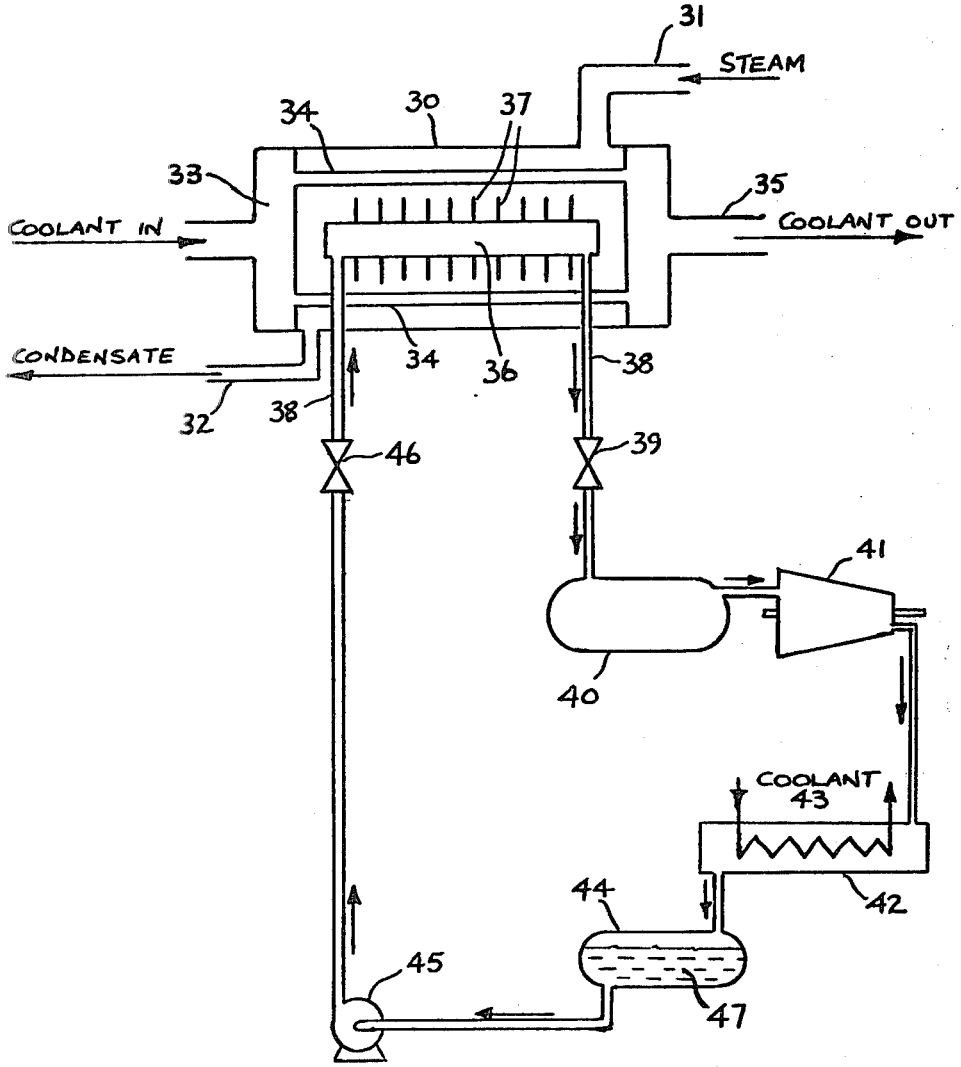

FIG. 3 refers to another embodiment of the present invention as applied to a steam condenser and illustrates, schematically and to a much reduced scale, components of the steam condenser and of apparatus according to the present invention adapted to promote condensation of steam entering the steam condenser.

Figure 1:
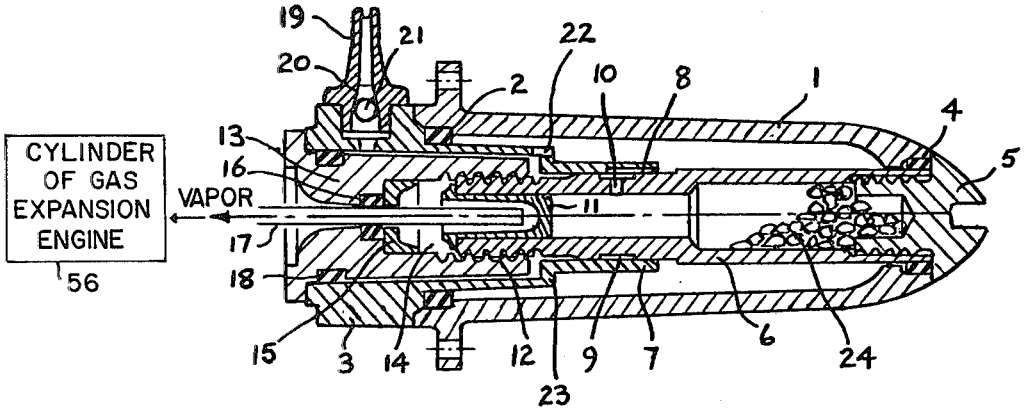
FIG. 1 illustrates, in vertical cross-section and approximately twice full size, a gas-supply tank of 3 cubic centimeters capacity and adapted according to the present invention to carry upto 2½ grams of largely-liquid carbon dioxide and to supply carbon dioxide vapour suitable for use, inter alia, in driving the motor of a model aircraft.

Referring to FIG. 1, a substantially cylindrical container 1 advantageously made of injection-moulded high-strength plastic material such as acetal is sealed at one end by the tank 'O' ring to a body member 3 and is sealed at its other end by the screw 'O' ring 4 to the screw head 5. The screw head 5 engages by threaded connection with a hollow screw 6 and these two components are preferably made of high-strength thermally-conducting material such as aluminium alloy, although in some applications the screw head 5 may advantageously be of low thermal conductivity material such as TUFNOL (Registered Trade Mark) for reasons given later herein.

The hollow screw 6 fits tightly within a sleeve portion 7 of the body member 3 so as to prevent any significant flow of liquid carbon dioxide through the sleeve portion 7, although a passageway 8 in the sleeve portion and a groove 9 and hole 10 in the hollow screw permit carbon dioxide to flow into and out of the hollow screw. The leftward end (as in FIG. 1) of the hollow screw is plugged sealingly by the screw plug 11 and the same end of the hollow screw engages by threaded connection 12 with the outlet adaptor 13. Both male and female threads of the threaded connection 12 are truncated so as to permit carbon dioxide to flow therethrough along the two helical pathways formed between the truncated threads.

The outlet adaptor 13 is provided with a substantially cylindrical cavity 14 terminating in a cup-shaped 'O' ring retainer 15 which retains a tube 'O' ring 16 and squeezes it to seal on an outlet tube 17. The outlet adaptor is sealed by the adaptor 'O' ring 18 to the body member 3 which is joined in a gas-tight manner (preferably by ultrasonic welding) to a filling nozzle 19 provided with an interior frustro-conical seat 20 and a ball valve 21 so as to allow carbon dioxide to be injected into the container 1 from an external refilling bottle (not shown, being of known type) though preventing escape of carbon dioxide from the filling nozzle 19.

A gas offtake aperture 22 is provided at the highest point of the shoulder 23 of the body member so that carbon dioxide may pass therethrough from within the container 1 to the threaded connection 12 and thence to the outlet tube 17 which is positioned substantially on the central axis of the cavity 14, the cup-shaped 'O' ring retainer 15 and the screw plug 11. Outlet tube 17 is adapted for connection to the cylinder of a gas expansion engine 56 which, in combination with container 1, forms a power unit, such as for a model aircraft or other model.

In some applications of the present invention it may be advantageous to fill the hollow screw 6 at least partly with an auxiliary material 24 for a variety of reasons. By way of example the auxiliary material 24 may comprise numerous small capsules of a buffer substance as defined and more fully explained in UK Pat. No. 1,561,831 which is incorporated herein for reference, whereby the heat released by a change of state of the buffer substance at a certain falling temperature may be usefully employed to assist vaporisation and/or superheating of the carbon dioxide. Alternatively or in addition, the auxiliary material 24 may comprise granules of fused alumina which will promote vaporisation of carbon dioxide and suchlike gases. Alternatively or in addition, the auxiliary material may comprise charcoal, silica or alumina or the like which, in their activated forms, have the property of adsorbing large amounts of carbon dioxide and the like and simultaneously releasing heat (which may then assist the vaporisation and/or superheating of the carbon dioxide or the like) and, conversely when the container 1 of the present invention is discharged, have the property of desorbing the carbon dioxide or the like whilst simultaneously absorbing heat and thereby becoming very cold. Such coldness, generated within the hollow screw 6 and transferred to its outer wall, is the primary process whereby the main object of the present invention is achieved, namely, the condensation of gas or vapour into liquid phase within the container 1, as is now explained.

In operation of the FIG. 1 embodiment, the outlet tube 17 is first connected for example to a motor or other device requiring vaporised carbon dioxide or the like in such manner that vapour does not flow out of the outlet tube until the motor or other device is put into operation. The container is then given a first charge of carbon dioxide by application of a refilling bottle (not shown) to the filling nozzle 19, whereupon approximately 1 gram of carbon dioxide will flow in. The first charge of carbon dioxide will normally be largely of vapour phase, with only a small puddle of liquid phase forming on the base of the container 1 and another small puddle forming within the hollow screw 6. Indeed, such a charge of only some 1.0 gram in a 3.0 cubic centimeter tank (i.e. a "Filling Ratio" of 0.333 gm/cc) is all that can be normally achieved in conventional simple tanks used heretofore; the main object of the present invention is to achieve a Filling Ratio considerably higher than 0.333 gm/cc.

To achieve this main object, the first charge of about 1 gram of carbon dioxide is discharged by operating the motor or other device connected to the outlet tube, or by depressing the ball valve 21 to unseat it from the frustro-conical seat 20 (by use of a suitable probe pressed into the filling nozzle 19), or by other means not shown in FIG. 1. The effect of discharging the FIG. 1 embodiment is to cause the hollow screw 6 to cool down significantly, as the carbon dioxide therewithin vaporises and expands through the hole 10 and thence through the outlet tube. Moreover the hollow screw stays cool for a long time (of the order of 1 to 10 minutes, or more with suitable design) after such discharging, because it is thermally insulated from ambient sources of heat by the surrounding container 1, outlet adaptor 13 (which for this reason should be of thermally-insulating material such as plastics) and body member 3. Indeed the screw head 5 provides the only significant path along which heat may flow into the hollow screw and accordingly is designed to provide a desired delay before the hollow screw loses its coldness: if made of aluminium alloy to the FIG. 1 embodiment the delay will be approximately 1–2 minutes; if made of steel, 2–4 minutes; if made of TUFNOL (Registered Trade Mark), 4–12 minutes; and so on with other materials and suitable variations in design and sizing of relevant components.

A second charge is then applied whereupon the entering carbon dioxide (which will normally be partly vaporised) comes into contact with the cold hollow screw which has the effect of promoting rapid condensation. Indeed, without this central feature of the present invention, entering vapour normally experiences the phenomenon of ¢supercooling" whereby it fails to condense despite being several degrees K below its saturation temperature. In contrast, contact with the cold hollow screw (which should be a few degrees colder still than the coldest temperature that the vapour can remain as supercooled vapour) has the effect of de-stabilising any supercooled vapour and causing its immediate condensation. This effect propagates to any surrounding vapour and causes it likewise largely to condense, though the latent heat of vaporisation released by such condensation will normally allow a relatively small amount of vapour to remain at the top of the container and of the hollow screw.

Figure 2:
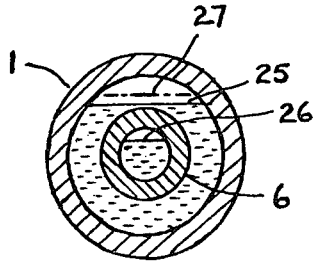
FIG. 2 is an end view, simplified and in vertical cross-section, of the gas-supply tank illustrated in FIG. 1 and to the same scale, showing a cross-section of the container and receptacle of the present invention and indicating the surface levels of the liquid carbon dioxide typically obtained in the said container and said receptacle.

Referring now to FIG. 2 which shows a simplified cross-section of the container 1 and the hollow screw 6, the liquid levels 25 and 26 in the container and hollow screw respectively are depicted as they will normally result after charging the FIG. 1 embodiment on a second or subsequent occasion following a previous discharging and within the delay period before the hollow screw warms up as hereinbefore described. These depicted liquid levels correspond to a carbon dioxide Filling Ratio of 0.75 to 0.85 gm/cc compared with the normal maximum of about 0.333 gm/cc achieved heretofore. Thus the present invention increases the useful mass of carbon dioxide or the like charged into a container of a given capacity—and increases the useful work or other service performed thereby—by a factor of approximately 2.5.

However as seen in FIG. 2 the liquid level in the container is much higher than the central axis, which is a preferred position for the outlet tube in many applications as shown in FIG. 1, and hence poses the problem of undesired liquid phase rather than vapour being delivered. Therefore, in its second aspect, the present invention discloses means to overcome this problem as now described.

The problem is first minimised by selecting a gas offtake level 27 higher than the highest expected liquid level 25, as seen in FIG. 2, when the container is in its normal operating attitude e.g. horizontal as in the FIG. 1 embodiment which is intended for horizontal mounting in model aircraft or for use in other applications with the leftward end (as in FIG. 1) inclined upwards. Referring to FIG. 1, the gas offtake aperture 22 is then designed to be at a level at least as high as the selected gas offtake level 27.

However, situations such as the aerobatic manoeuvring of a model aircraft etc. may still cause the gas offtake aperture to become occasionally flooded by liquid carbon dioxide or the like and therefore the present invention proposes means such as the helical pathways formed by the truncated threads of the threaded connection 12 whereby any liquid phase entering therein will issue into the cavity 14 with a high-speed swirling motion. The cross-sectional area of the flow paths formed by the said truncated threads are chosen so that, at the known rate of gas or vapour consumption by the e.g. motor, the angular velocity of any liquid phase issuing into the cavity will be sufficient to throw such liquid phase firmly outwards against the bounding cylindrical wall of the cavity. For example in the FIG. 1 embodiment the total cross-sectional flow area of the two helical pathways is not more than 0.1 square millimeters so that, at the lowest designed flow rate of 2 grams per minute, the angular velocity in the cavity will be at least 800 radians/second with vapour flow and generally over 200 radians/second when liquid phase is present. With a cavity diameter of 0.6 centimeters an angular velocity of 200 radians/second provides a centripetal acceleration at the cavity wall of 12,000 $cm/sec^2$ which is generally sufficient to prevent liquid phase from reaching the outlet tube 17; instead, vapour phase escapes from the layer of liquid phase flung outwards against the cavity wall and migrates towards the central axis and hence into the outlet tube. To assist such vaporisation in the cavity, the cavity wall should advantageously be of thermally-conducting material in thermal connection with ambient surroundings or provided with an enclosing jacket containing a buffer substance as described hereinbefore and in UK Pat. No. 1,561,831; suchlike components are not shown in FIG. 1, being of known art and unnecessary at the low power output level provided by the FIG. 1 embodiment.

Referring to FIG. 3, a condenser 30 of the shell-and-tube type is supplied with steam by an inlet pipe 31 in order to produce water condensate from an outlet pipe 32. The great majority of latent heat of vaporisation extracted from the steam in this process is removed by a stream of coolant (which may be water or other suitable medium) which enters a header 33, flows through a plurality of tubes 34 and leaves the condenser 30 by a coolant outlet pipe 35.

A receptacle 36, advantageously provided with numerous fins 37 which extend into the steam flowing into the condenser and constructed of high thermal conductivity material such as aluminium alloy, is supported within the condenser and linked by suitable pipework 38 to an external circuit of apparatus including a venting valve 39, a vapour receiver 40, a compressor 41, a cooler 42 supplied with a suitable coolant 43 such as cold water, a liquid receiver 44, a feed pump 45 and a stop valve 46. The liquid receiver 44 is charged with a refrigerant liquid 47 which may suitably be the refrigerant commonly known as R12 and having the chemical formula $CCl_2F_2$ or which may be another of the FREONs (Registered Trade Mark), butane, propane, ammonia, carbon dioxide or the like, according to known refrigeration art and the desired steam condensing temperature in the condenser. The choice of this refrigerant liquid 47 should be such that, at the pressure within the vapour receiver 40, the refrigerant liquid will vaporise at a temperature at least 10 degrees K and preferably 20 to 30 degrees K lower than the steam condensing temperature.

In operation of the FIG. 3 embodiment, stop valve 46 is opened and venting valve 39 is closed and the feed pump 45 is used to charge the receptacle 36 with refrigerant liquid 47. Stop valve 46 is then closed and venting valve 39 opened, whereupon the refrigerant liquid within the receptacle vaporises and rapidly cools the receptacle and its fins 37 to a temperature several degrees K below the lowest supercooled temperature that can be exhibited by the steam entering the condenser 30; this has the effect of de-stabilising any supercooled steam in the proximity of the receptacle and causing rapid condensation thereof, the latent heat of vaporisation so released being carried away largely by the coolant leaving by the coolant outlet pipe 35.

Vaporised refrigerant produced from the receptacle flows to the vapour receiver 40, is compressed by the compressor 41, condensed by the cooler 42 and stored in the liquid receiver 44.

The receptacle-charging and liquid-vaporising operation hereinbefore described may then be repeated to induce a further surge of condensation within the condenser, and so on in a cyclical manner so as to achieve a desired enhancement and speeding-up of the steam condensation.

Of course the FIG. 3 embodiment may be adapted to promote and enhance the condensation of vapours other than steam, for example the vapours of the FREONs (Registered Trade Mark), butane, propane, ammonia and the like.

What is claimed is:

1. A method of condensing a pressure-liquefiable gas or vapour, said method comprising the steps of:

feeding said gas or vapour into the interior of a closed container;

introducing a liquid derived from said gas or vapour into the interior of a hollow condensing element mounted in said container with its outer surface in contact with the gas or vapor inside the container; and exhausting the contents of said condensing element to cool the outer surface thereof to a temperature below the condensation temperature of said gas or vapour.

2. A method according to claim 1, wherein the outer surface of said condensing element is cooled to a temperature at least 10° C. below the condensation temperature of said gas or vapour.

3. A method according to claim 1 or 2 wherein said gas or vapour is selected from the group consisting of carbon dioxide, water vapour, butane, propane, ammonia or a FREON (Registered Trade Mark).

4. A method according to claim 1, wherein said condensing element contains an auxiliary material to assist vaporisation and/or superheating of the liquid introduced therein.

5. A method according to claim 4, wherein said auxiliary material comprises a buffer substance which undergoes a change in its physical, chemical, crystallographic or other state at a temperature between ambient and the final operating temperature of said liquid, said change of state causing a release of heat to said liquid.

6. A method according to claim 4, wherein said auxiliary material comprises fused alumina.

7. A method according to claim 4, wherein said auxiliary material comprises activated and unactivated charcoal, silica or alumina.

8. A method according to claim 1 further comprising the step of withdrawing said gas or vapour from the interior of said container through an outlet passage.

9. A method according to claim 8, wherein the gas or vapour is withdrawn from the interior of said container at a point which normally lies above the level of the liquid therein and is given a swirling motion at a velocity sufficient to separate any entrained liquid therefrom by centrifugal force before leaving the container.

10. A method according to claim 9, wherein the swirling gas or vapour takes up heat from its surroundings.

11. Apparatus for promoting the condensation of a pressure-liquefiable gas or vapour, said apparatus comprising:

a closed container having an inlet for said gas or vapour; a condensing element mounted within said container and comprising a hollow receptacle the exterior of which is exposed to the contents of the container and the interior of which communicates with the interior of said container; and means for exhausting the contents of said receptacle in order to cool the outer surface of said condensing element to a temperature below the condensation temperature of said gas or vapour.

12. Apparatus according to claim 11, wherein said condensing element is made of metal.

13. Apparatus according to claim 11 or 12, wherein said condensing element is thermally insulated from said container.

14. Apparatus according to claim 11, wherein said container is provided with an outlet passage for gas or vapour, the inner end of said passage opening into the interior of the container through an aperture situated above the level normally reached by liquid derived from the gas or vapour fed thereto.

15. Apparatus according to claim 14, wherein said outlet passage includes a section of substantially helical form for imparting a swirling motion to gas or vapour passing therethrough followed by a section of substantially cylindrical form to retain any liquid removed from the swirling gas or vapour by centrifugal force.

16. Apparatus according to claim 15, wherein said outlet passage includes a delivery duct downstream of and coaxial with said cylindrical section.

17. Apparatus according to claim 15 or 16, wherein the wall of said cylindrical section is formed by thermally conducting material.

18. Apparatus according to any one of claims 14 to 16, wherein the outer end of said outlet passage is connected to the cylinder of a gas expansion engine combined with said container to form a power unit for a model aircraft or other working model.

19. A method of condensing a pressure-liquefiable gas within a closed container comprising the steps of:

feeding a first quantity of a pressurized gas into the interior of a hollow condensing element disposed within the closed container;

exhausting the pressurized gas from the interior of the hollow condensing element to cool an outer surface thereof to a temperature below the condensation temperature of the gas; and introducing a second quantity of the pressurized gas into the interior of the closed container in contact with the outer surface of the hollow condensing element for cooling thereof to a temperature below its condensation temperature.

20. Apparatus for promoting the condensation of a pressure-liquefiable gas comprising:

a closed container;

an condensing element disposed within said container and having a hollow interior and an exterior surface exposed to the contents of the container, the interior of said condensing element being in gaseous communication with the interior of said container;

inlet means for introducing gas under pressure into the interior of said inner condensing element and into the interior of said container in contact with the exterior surface of said condensing element; and means for selectively recovering the gas from the interior of said container for use outside of said container and for exhausting the gas from the interior of said condensing element to cool said exterior surface of said condensing element to a temperature below the condensation temperature of the gas, said selective recovering and exhausting means comprising helical path means for removing liquid from the gas.

* * * * *